United States Patent [19]

Washino et al.

[11] Patent Number: 4,896,642

[45] Date of Patent: Jan. 30, 1990

[54] CONTROL DEVICE FOR AN INTERNAL COMBUSTION ENGINE

[75] Inventors: Shoichi Washino; Satoru Ohkubo, both of Amagasaki, Japan

[73] Assignee: Mitsubishi Denki Kabushiki Kaisha, Tokyo, Japan

[21] Appl. No.: 250,211

[22] Filed: Sep. 28, 1988

[30] Foreign Application Priority Data

Sep. 29, 1987 [JP] Japan ..... 62-246559
Sep. 29, 1987 [JP] Japan ..... 62-246560

[51] Int. Cl.[4] ..... F02P 5/04
[52] U.S. Cl. ..... 123/435; 123/425
[58] Field of Search ..... 123/425, 435, 422; 73/35; 364/431.08, 431.07

[56] References Cited

U.S. PATENT DOCUMENTS

| | | | |
|---|---|---|---|
| 4,750,103 | 6/1988 | Abo et al. | 123/425 |
| 4,760,828 | 8/1988 | Shimada et al. | 123/425 |
| 4,766,545 | 8/1988 | Nagai | 123/425 |
| 4,819,171 | 8/1989 | Morita | 123/425 |

*Primary Examiner*—Raymond A. Nelli
*Attorney, Agent, or Firm*—Oblon, Spivak, McClelland, Maier & Neustadt

[57] ABSTRACT

The maximum inner pressure of a cylinder of an internal combustion engine and the crank angle at the time when the maximum inner pressure takes place are detected. On the basis of the values as detected, a cylinder temperature is calculated whereby an amount of fuel to be injected to the cylinder, an air-fuel ratio or an ignition timing is controlled.

13 Claims, 16 Drawing Sheets

15: control apparatus

15: control apparatus

12: control apparatus

| Tp (ms) | 800 | 2000 | 3200 | 4000 | 4800 | 5600 | 6400 |
|---|---|---|---|---|---|---|---|
| 5 | 20 | 30 | 30 | 40 | 40 | 40 | 40 |
| 4 | 15 | 20 | 20 | 20 | 30 | 30 | 40 |
| 3 | 10 | 10 | 10 | 15 | 20 | 25 | 35 |
| 2 | 10 | 0 | 0 | 10 | 15 | 20 | 30 |
| 1 | 10 | 0 | 0 | 10 | 15 | 20 | 25 |
| 0 | 10 | 0 | 0 | 10 | 15 | 20 | 20 |

Engine revolution number N(rpm)

15: Control apparatus

CONTROL DEVICE FOR AN INTERNAL COMBUSTION ENGINE

BACKGROUND OF THE INVENTION

1. Field of the Invention

The present invention relates to a control apparatus for an internal combustion engine capable of suppressing an increase in the concentration of $NO_x$ in exhaust gas. Particularly, it relates to such a control apparatus for controlling the concentration of $NO_x$ by controlling a fuel injection quantity, an air-fuel ratio or an ignition timing on the basis of information of a temperature of cylinder.

2. Discussion of Background

FIG. 18 is a diagram showing a conventional air-fuel ratio control apparatus as shown, for instance, in Japanese Unexamined Patent Publication No. 2443/1983. In FIG. 18, a numeral 1 designates an air cleaner, a numeral 2 an air flow meter for measuring an intake air quantity, a numeral 3 a throttle valve, a numeral 4 an intake air manifold, a numeral 5 a cylinder, a numeral 6 a water temperature sensor for detecting a temperature of cooling water, a numeral 8 an exhaust air manifold, a numeral 9 an exhaust gas sensor for detecting the concentration of a component (for instance, oxygen concentration) in exhaust gas, a numeral 10 a fuel injection valve, a numeral 11 an ignition plug, a numeral 15 an air-fuel ratio control apparatus, and a numeral 17 a temperature sensor for exhaust gas.

The operation of the conventional control apparatus will be described. The air-fuel ratio control apparatus 15 receives an intake air quantity signal S1 from the air flow meter 2, a water temperature signal S3 (not shown) from the water temperature sensor 6 and an exhaust gas signal S4 from the exhaust gas sensor 9, when the value of an exhaust gas temperature signal S7 from the exhaust gas temperature sensor 17 is lower than a predetermined value, and outputs a fuel injection signal S5 to the fuel injection valve 10 in order to effect an air-fuel ratio feed-back control.

On the other hand, when an exhaust gas temperature detected by the exhaust gas sensor 17 exceeds a predetermined value in a high temperature zone. The feed-back control is stopped by the air-fuel ratio control apparatus 15 so that an air-fuel ratio is rendered to be smaller (a rich side) than a theoretical air-fuel ratio to thereby avoid an abnormal combustion and thermal deterioration of a catalyst.

In the conventional air-fuel ratio control apparatus having the construction as above-mentioned, accuracy of estimation was poor because a combustion temperature in a cylinder is estimated indirectly from the temperature of exhaust gas. Further, accuracy in an air-fuel control was low because of a low temperature-measuring speed, whereby it was insufficient to prevent generation of $NO_x$ from increasing.

There has been known an apparatus for controlling fuel injection for an internal combustion engine with a fuel injection device as disclosed in, for instance, Japanese Unexamined Patent Publication No. 148636/1981. In such apparatus, however, a fuel injection timing is not always an optimum timing because of the characteristics of an engine to be used when the time of finishing of fuel injection is made in agreement with a predetermined crank angle, with the consequence that the performance of the engine can not sufficiently be obtained with respect to stability of combustion, an engine output and exhaust gas characteristics.

SUMMARY OF THE INVENTION

It is an object of the present invention to provide a control apparatus for an internal combustion engine capable of preventing the concentration of $NO_x$ in exhaust gas from abnormally increasing even under any condition of the internal combustion engine in which a combustion temperature is controlled to be lower than a predetermined value depending on operational conditions of the engine.

According to an aspect of the present invention, there is provided a control apparatus for a spark ignition type internal combustion engine adapted to measure an intake air quantity and an engine revolution number, to calculate a basic fuel injection quantity by taking account of the intake air quantity and the engine revolution number and to inject fuel on the basis of a signal of the basic fuel injection quantity, which comprises a pressure detecting means to detect an inner pressure of cylinders P, a crank angle detecting means to detect a crank angle $\theta$ of the engine, a control device which is adapted to receive the output signals of the pressure detecting means and the crank angle detecting means to detect the maximum value $P_{max}$ of the cylinder inner pressure in a single ignition cycle and the crank angle $\theta P_{max}$ at the time of the maximum pressure value $P_{max}$ taking place, to calculate a temperature of cylinder $TP_{max}$ by using the maximum pressure value $P_{max}$ and the crank angle $\theta P_{max}$, and to output a control signal for controlling fuel on the basis of the temperature $TP_{max}$, and means for operating a manipulated variable depending on the control signal.

According to another aspect of the present invention, there is provided a control apparatus for a spark ignition type internal combustion engine adapted to measure an intake air quantity and an engine revolution number, to calculate a basic fuel injection quantity by taking account of the intake air quantity and the engine revolution number, and to inject fuel on the basis of a signal of the basis fuel injection quantity, which comprises a pressure detecting means to detect an inner pressure of cylinder P, a crank angle detecting means to detect a crank angle $\theta$ of the engine and a control device which is adapted to receive the outputs of detection signals of the both detecting means to calculate a parameter showing a change of power in a single ignition cycle, to calculate the mean value $T_{maxb}$ of the maximum temperature values $T_{maxn}$ of gas in a cylinder in predetermined ignition cycles on the assumption that the temperature of gas in the cylinder produced at the maximum inner pressure of cylinder $P_{maxn}$ is the maximum temperature $T_{maxn}$, and to control a fuel injection timing by using the parameter and the mean value $T_{maxb}$.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
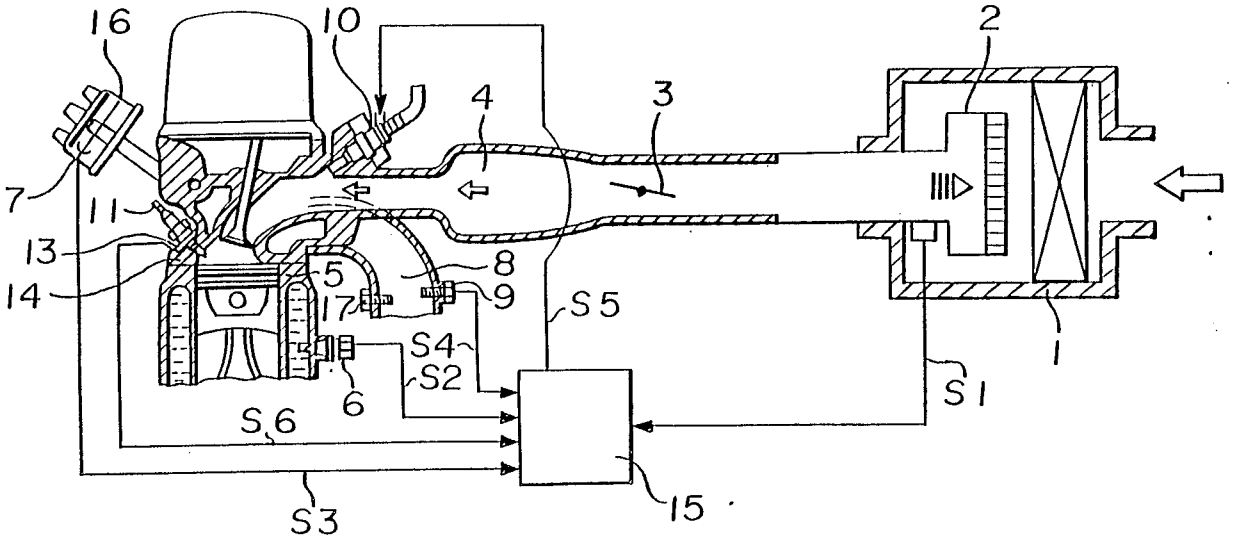
FIG. 1 is a diagram showing an embodiment of the control apparatus for an internal combustion engine according to the present invention.

Referring to the drawings, wherein the same reference numerals designate the same or corresponding parts throughout the several views, and more particularly to FIG. 1 thereof, there is shown a diagram showing the construction of an embodiment of the control apparatus. In FIG. 1, a reference numeral 7 designates a crank angle sensor to detect an angle of revolution of the engine. For instance, the sensor outputs a reference position pulse for each reference position of crank angle (each 180° for a four cylinder engine and each 120° for a six cylinder engine) and a unit angle pulse for each unit angle (for instance, each 1°).

A crank angle can be detected by counting the number of unit angle pulses after a reference position pulse has been read by the control apparatus 15. The number of revolution of the engine is also detected by measuring a frequency or a period of the unit angle pulse.

In the example of FIG. 1, the crank angle sensor is disposed in a distributor 16.

Figure 2:
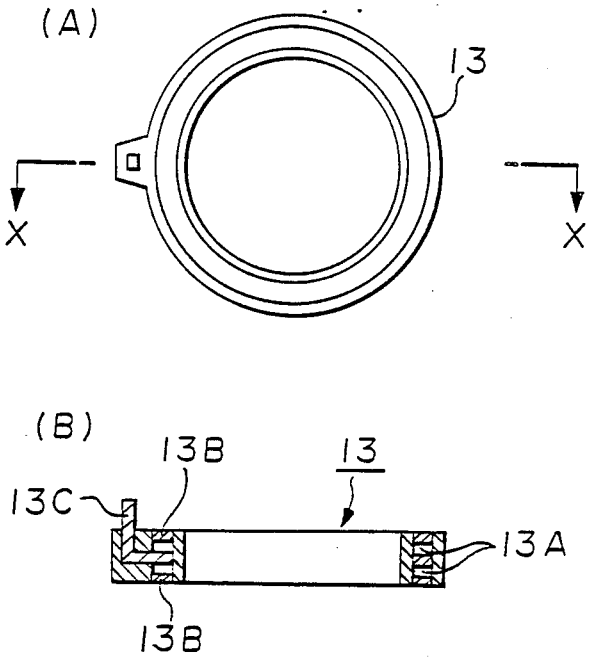
FIG. 2A is a front view showing an embodiment of a pressure sensor used for the embodiment shown in FIG. 1.
FIG. 2B is a cross-sectional view taken along a line X—X in FIG. 2A.

A numeral 13 designates a pressure sensor to detect an inner pressure of a cylinder. FIG. 2 shows an embodiment of the pressure sensor 13, in which FIG. 2A is a front view and FIG. 2B is a cross-sectional view taken along a line X—X in FIG. 2A.

In FIG. 2B, a numeral 13A designates a piezoelectric element of a ring form, a numeral 13B is a negative electrode of a ring form and a numeral 13C designates a positive electrode.

Figure 3:
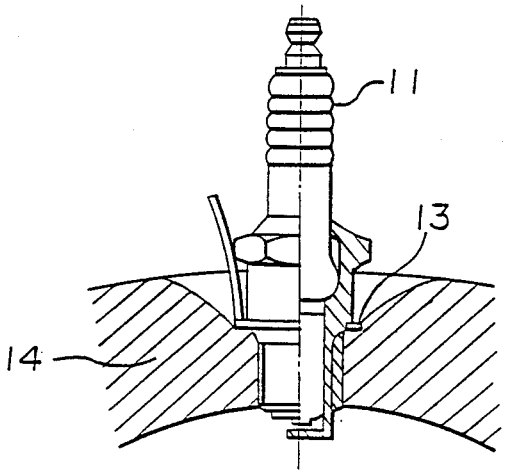
FIG. 3 is a front view partly cross-sectioned showing a state of fitting the pressure sensor shown in FIG. 2.

FIG. 3 is a diagram showing the pressure sensor 13 being fitted to a cylinder head 14 by fastening an ignition plug 11.

Figure 4:
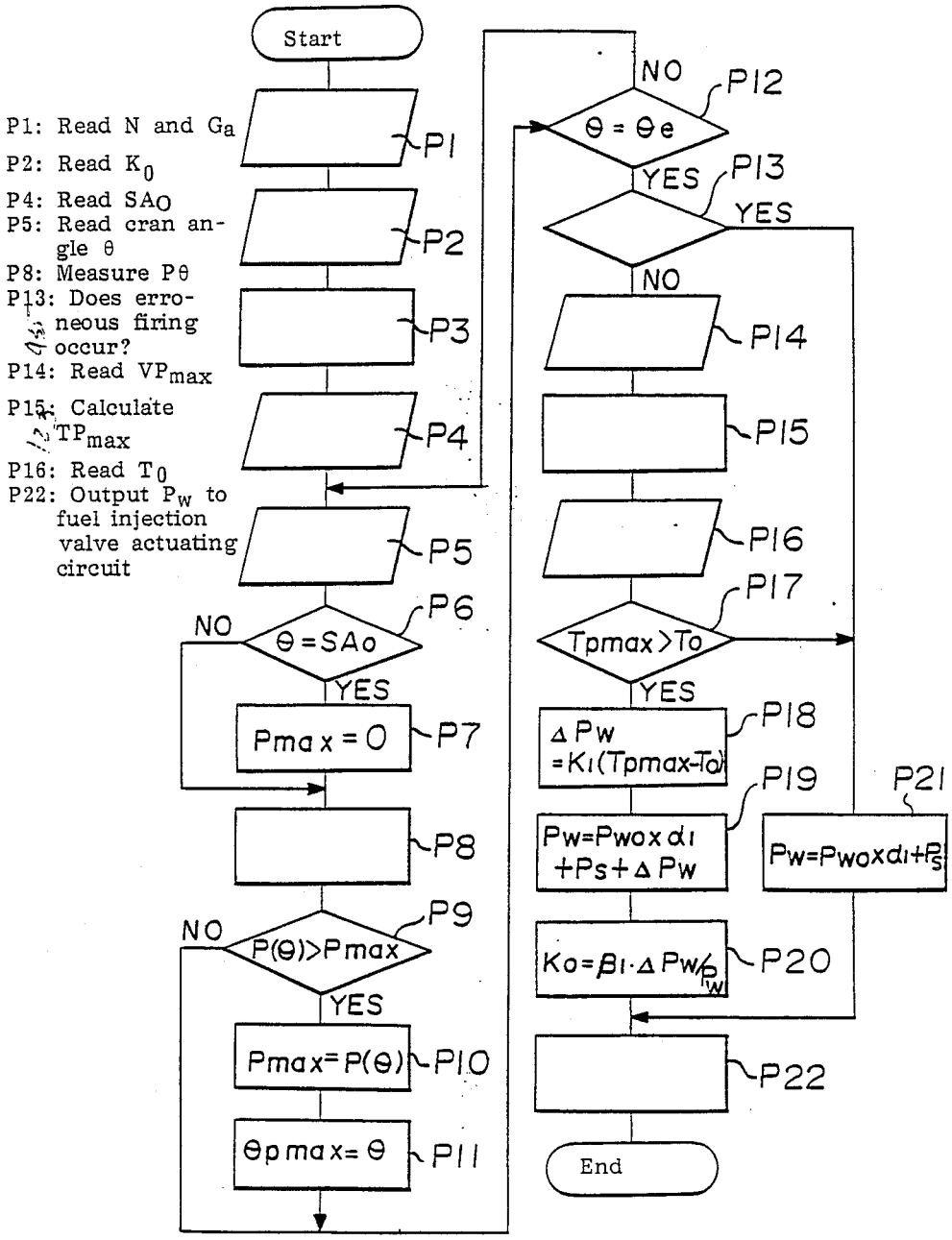
FIG. 4 is a flow chart showing a series of arithmetic processes carried out by the control apparatus.

The operation of the embodiment shown in FIG. 1 will be described with reference to a flow chart of FIG. 4 which represents a control of air fuel ratio. In FIG. 4, P1–P22 indicate sequential steps for processings.

In FIG. 4, the control apparatus 10 reads an engine revolution number N by receiving a signal S3 from the crank angle sensor 7, and at the same time, it reads an intake air quantity $G_a$ from a signal S1 supplied from the air flow meter 2 (Step P1).

At Step 2, the control apparatus 15 reads a constant $K_0$ used for calculating a basic fuel injection quantity from a table which is obtained by learning. At Step S3, the basic fuel injection quantity $P_{w0}$ is calculated by using the values N and $G_a$ read at Step P1 and the constant $K_0$ read at Step P2 as well as an equation $P_{w0}=K_0.G_a/N$.

At Step P4, an ignition timing $SA_0$ is read from a data table which is related to the engine revolution number N and the intake air quantity $G_a/N$.

At Step P5, a crank angle 8 is read from the signal of the crank angle sensor 7. Then, determination is made as to whether or not the crank angle $\theta$ read at Step P5 is equal to the ignition timing $SA_0$ read at Step P4 (Step P6). When "NO" (negative) at Step P6, then, Step P8 is immediately taken.

When "YES" (affirmative) at Step P6, the maximum inner pressure of cylinder $P_{max}$ is changed to zero and an inner pressure of cylinder $P(\theta)$ at that time is measured and memorized (Step P8).

At Step P9, determination is made as to whether or not the inner pressure of cylinder $P(\theta)$ measured at Step P8 is greater than the maximum inner pressure of cylinder $P_{max}$ previously memorized.

When "NO" at Step P9, then, Step P12 is immediately taken. On the other hand, when "YES" at Step P9, then, Step P10 is taken at which the inner pressure of cylinder $P(\theta)$ at the present time is memorized as the maximum inner pressure of cylinder $P_{max}$ to be obtained.

At Step P11, a crank angle $\theta P_{max}$ at which the maximum inner pressure of cylinder is produced (the angle at the time of the inner pressure of cylinder becoming the maximum) is memorized.

Figure 5:
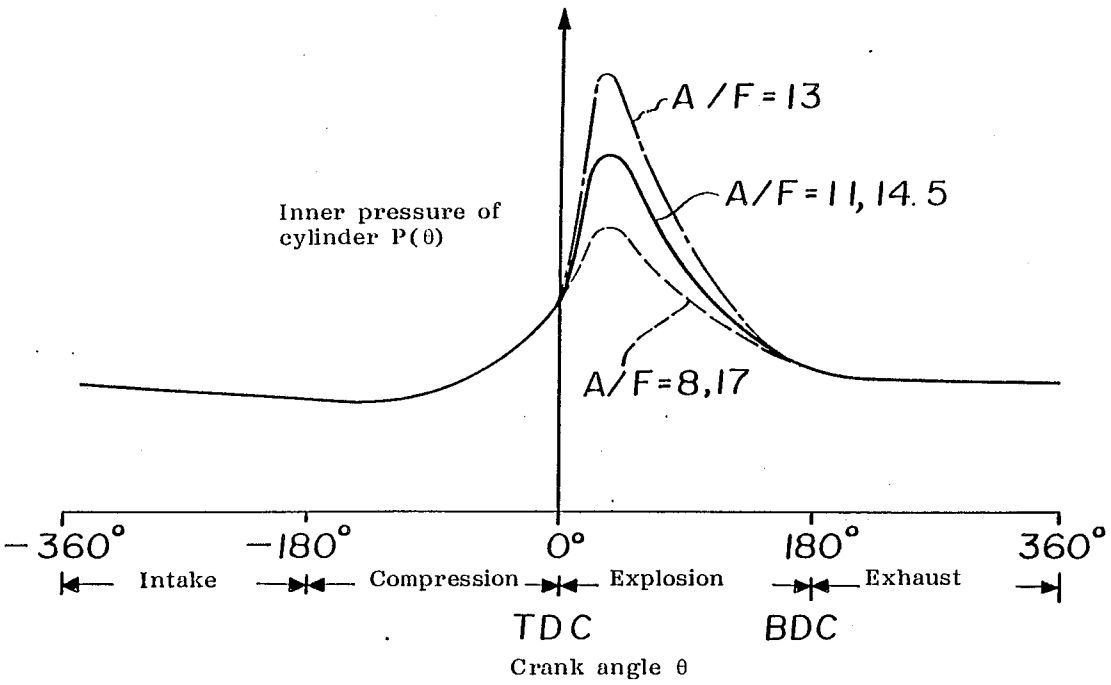
FIG. 5 is a characteristic diagram showing the relation of an inner pressure of cylinder and a crank angle at changed air-fuel ratios.

At Step P12, determination is made as to whether or not the crank angle $\theta$ is changed to $\theta_e$ which is a value obtained by adding a predetermined crank angle (such as 40°) to the ignition timing $SA_0$ read at Step P4. The value $\theta_e$ is experimentally obtained so that the maximum inner pressure of cylinder $P_{max}$ is generated at a crank angle position between the ignition timing $SA_0$ and $\theta_e$ (see FIG. 5).

When "YES" at Step P12, Step P13 is taken because a zone in which the maximum inner pressure of cylinder $P_{max}$ is produced is ended.

When "NO" at Step P12, the sequential Step is returned to Step P5 so that the above-mentioned Steps P5-P11 are repeated.

At Step P13, determination is made as to whether or not there takes place an erroneous firing. Step P13 is provided to eliminate an erroneous detection of the maximum value $P_{max}$ caused by an erroneous firing. Determination of the erroneous firing is made in such a case that the crank angle $\theta P_{max}$ obtained at Step P11 is at or near the upper dead point of the compression stroke and an increasing rate of the inner pressure cylinder $dP/d\theta$ is lower than a predetermined value.

When "YES" at Step P13, Step P21 is immediately taken.

On the other hand, when "NO" at Step P13, then, Step 14 is taken at which a cylinder capacity $VP_{max}$ obtained when the maximum inner pressure of cylinder is produced is read from a data table by using the value $\theta P_{max}$ read at Step P11. The data table is prepared by using the following equation (1):

$$VP_{max}=S\times R\times[\{1-\cos(\theta P_{max})\}+\lambda\times\{1-(1-r)^{0.5}\}] \quad (1)$$

where $S=\pi/4d^2.d$ is an inner diameter of cylinder, $\lambda=L/R.L$ is a length of connecting rod, R is a radius of crank and $r=\{\sin(\theta P_{max})/\lambda\}^2$.

At Step P15, the following equation (2) is used to calculate an inner temperature of cylinder $TP_{max}$ when the inner pressure of cylinder $P(\theta)$ becomes the maximum.

$$TP_{max}=\frac{P_{max}\cdot VP_{max}}{G_a/N\cdot R} \quad (2)$$

where $P_{max}$ is the maximum pressure of cylinder read at Step P10, $VP_{max}$ is the cylinder capacity read at Step P14, $G_a$ is the intake air flow rate read at Step P1, R is a constant of gas and N is an engine revolution number.

Figure 6:
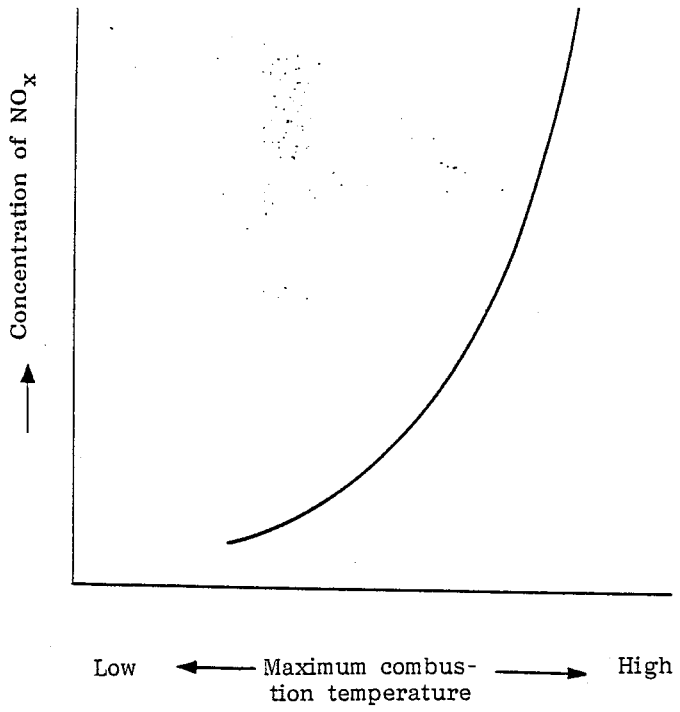
FIG. 6 is a characteristic diagram showing the relation between the maximum combustion temperature and the concentration of $NO_x$ to illustrate the above-mentioned embodiment.

Then, a predetermined temperature $T_0$ corresponding to the engine revolution number N and the intake air quantity $G_a/N$ are read from data tables (Step P16). When the temperature of cylinder $TP_{max}$ exceeds the predetermined temperature $T_0$, an amount of $NO_x$ in the exhaust gas increases (see FIG. 6).

At Step P17, determination is made as to whether or not $TP_{max}$ obtained at Step P15 is greater than $T_0$ read at P16.

When "NO", then, Step P21 is taken because it is unnecessary to change the air-fuel ratio, and a fuel injection quantity $P_w$ is finally calculated by using the following equation (5):

$$P_w=P_{w0}\times\alpha_1+P_s \quad (3)$$

where $P_{w0}$ is the basic fuel injection quantity obtained at Step P3, $\alpha_1$ is an air-fuel ratio feed-back coefficient obtained by the oxygen concentration sensor and $P_s$ is a correction quantity obtained by a voltage of battery.

When "YES" at Step P17, then, Step P18 is taken, where a fuel correction quantity $\Delta P_w$ which is used for the control of an air-fuel on the rich side, is calculated by using the following equation (4):

$$\Delta P_w=K_1(TP_{max}-T_0) \quad (4)$$

where K is a constant.

Figure 7:
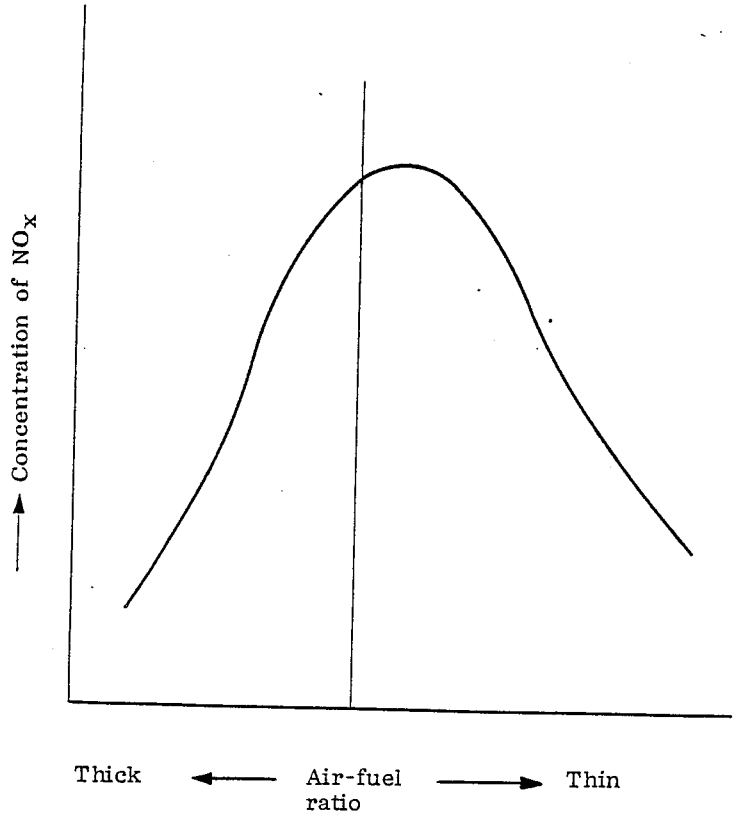
FIG. 7 is a characteristic diagram showing the relation between an air-fuel ratio and the concentration of $NO_x$ to illustrate the above-mentioned embodiment.

FIG. 7 is a graph showing a relation of an air-fuel ratio to the concentration of $NO_x$. As is apparent from FIG. 7, the concentration of $NO_x$ is high in the vicinity of the theoretical air-fuel ratio, and the concentration is decreased when the air-fuel ratio becomes thick or thin. In the embodiment of the present invention, control is made so as to be thicker (on the rich side) than that at the theoretical air-fuel ratio in order to reduce the temperature of cylinder without causing reduction in the output of the engine.

At Step P19, a fuel injection quantity $P_w$ in which the fuel correction quantity $\Delta P_w$ is added in response to the temperature of cylinder is calculated by using an equation (5):

$$P_w=P_{w0}\times\alpha_1+P_s+\Delta P_w \quad (5)$$

At Step P20, the value of the constant $K_0$ read at Step P2 is changed by using the following equation (6) in which $P_w$ obtained at Step P18 is used:

$$K_0=\beta.\Delta P_w/P_w \quad (6)$$

where $\beta$ is a constant.

Thus, the basic fuel injection quantity $P_{w0}$ in the case that operational conditions of the engine in the next ignition cycle are the same is calculated as a value corrected in such a manner that the cylinder temperature $TP_{max}$ does not exceed the predetermined temperature $T_0$.

At Step P22, a signal indicating the fuel injection quantity $P_w$ obtained at Step P21 is outputted to a fuel injection valve actuating circuit. By repeating the above-mentioned operations, a feed-back control for an air-fuel ratio is effected so that the cylinder temperature $TP_{max}$ does not exceed the predetermined temperature $T_0$, whereby an amount of $NO_x$ can be controlled.

A series of the calculations as above-mentioned has to be carried out at an extremely high speed (for instance, the routine from Step P5 to Step P12 in FIG. 4 has to be carried out within a time of a crank angle of 1°). Such high speed calculation is possible by using, for instance, a data-flow type processor (such as μPD7281 manufactured by Nippon Denki Kabushiki Kaisha) as a coprocessor.

A host processor (such as a Neumann type processor) can be used to carry out operations per one cycle (crank angle of 720°) such as decision of an engine operating point (Step P1), calculation of the fuel injection quantity $P_{w0}$ (Step P3), calculation of the maximum of gas temperature $TP_{max}$ in cylinder (Step P15), control of fuel injection timing and connection to a routine (such as one for obtaining the maximum pressure of cylinder and the crank angle position at that time of the maximum pressure taking place from Step P5 to Step P12) which is carried out by a coprocessor.

A data-flow type processor is so adapted that operations are effected by data. Accordingly, the connection to a routine conducted by the coprocessor can be made as follows. For instance, when a signal of crank angle is inputted to a host processor, it sends data of crank angle and inner pressure of cylinder $P(\theta)$ to a coprocessor which stores an operating program inclusive of Step P5 to Step P12. This can be done because the data-flow type processor can operate automatically when data necessary for it are provided. When determination of "YES" is given at Step P12, the data-flow type processor can only return information of the maximum pressure of cylinder $P_{maxn}$ to the host processor.

When the host processor receives the data, it starts a control of fuel injection timing as shown by Step P13 and subsequent steps as in the flow chart in FIG. 4. When the determination is given "NO", sequential step is returned to Step P5 to repeat the above-mentioned processes.

A self-supporting data-flow type processor is used as the host processor, a control of air-fuel ratio can be effected by executing the operational program described in the entire part of FIG. 4.

The above-mentioned is the description in the case that the maximum pressure of cylinder $P_{maxn}$ and the crank angle position $\theta_n$ at the time of the maximum pressure taking place are obtained by a program. However, such values can be obtained by means of a circuit such as a peak value holding circuit.

Figure 8:
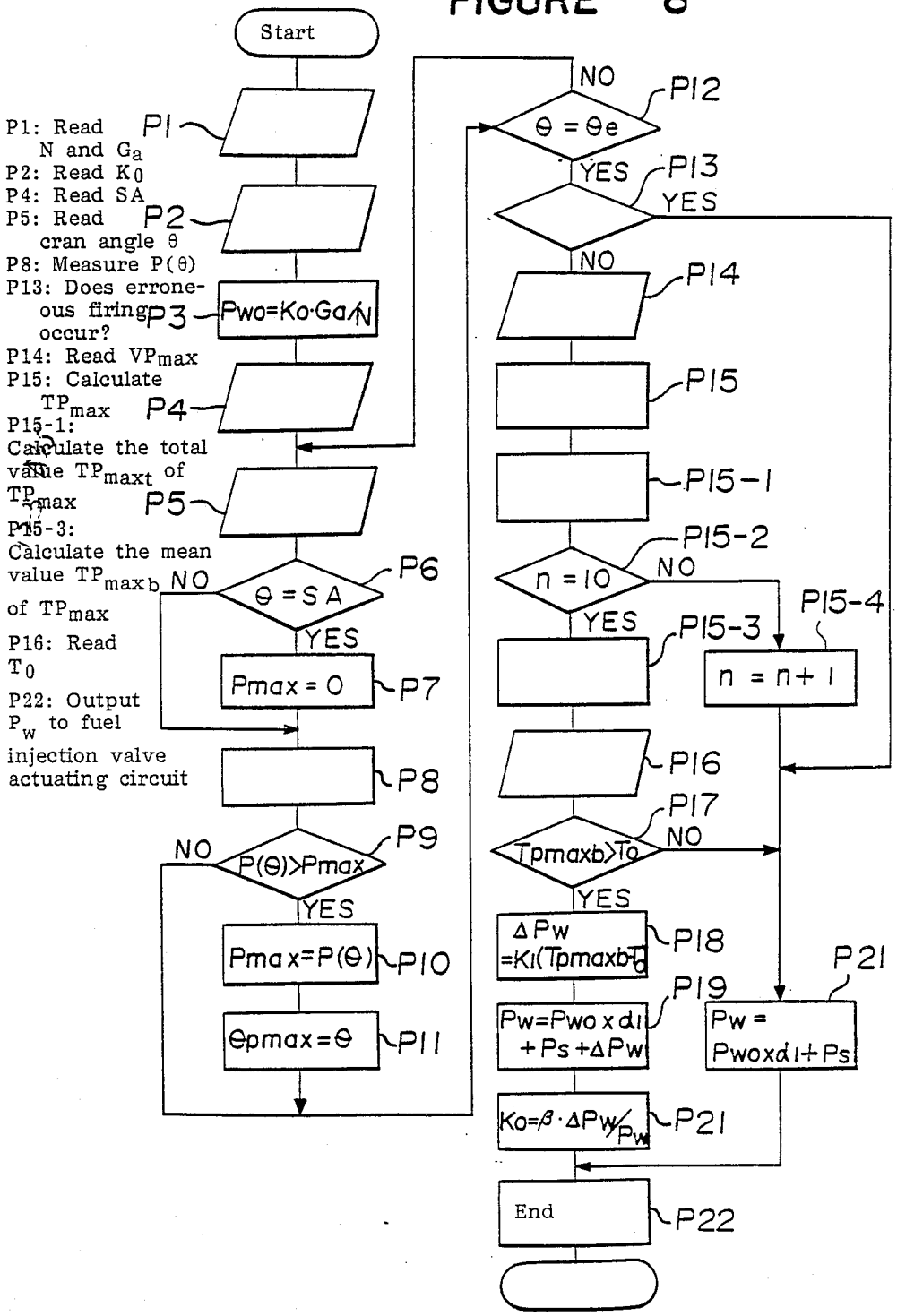
FIG. 8 is a flow chart showing a series of arithmetic processes of a second embodiment of the present invention.

FIG. 8 is a flow chart of a second embodiment which shows a flow of calculation of a fuel injection quantity. In FIG. 8, the processes from Step P1 to Step P15 are the same as those in FIG. 4. Namely, the cylinder temperature $TP_{max}$ is calculated at Step P15.

At Step P15-1, the total value of cylinder temperature $TP_{max}$ obtained up to this time is operated by using the following equation (7):

$$TP_{maxt}\text{ (present time)} = TP_{maxt}\text{ (previous time)} + TP_{max} \quad (7)$$

The value $TP_{maxt}$ and the value of counter n are initialized to be zero at the starting of the flow chart.

Then, determination is made as to whether or not the total value $TP_{max}$ is added predetermined times (such as ten times) at Step P15-2. When "NO" at Step P15-2, increment in value is conducted at Step P15-4 and Step P21 is taken.

When "YES" at Step P15-2, the mean value $TP_{maxb}$ of the values of cylinder temperature $TP_{max}$ is obtained at Step P15-3.

Then, at Step P16, the value $T_0$ is read in the same manner as in FIG. 4, and the value $T_0$ is compared with the value $TP_{maxb}$ obtained at Step P15-3 (Step P17).

When "YES" at Step P17, Step P18 is taken. On the other hand, when "NO", Step P21 is immediately taken, and thereafter, the same processes as in FIG. 4 are carried out.

By effecting the above-mentioned feed-back control of the air-fuel ratio and by using the mean value $TP_{maxb}$ of the cylinder temperature $TP_{max}$, response in a feed-back system is made insensible to thereby absorb scattering in the values of cylinder temperature $TP_{max}$ and to control an amount of $NO_x$ to be lower than a predetermined value.

In FIG. 8, the processes from Step P18 to Step P22 are the same as those in FIG. 4.

Figure 9:
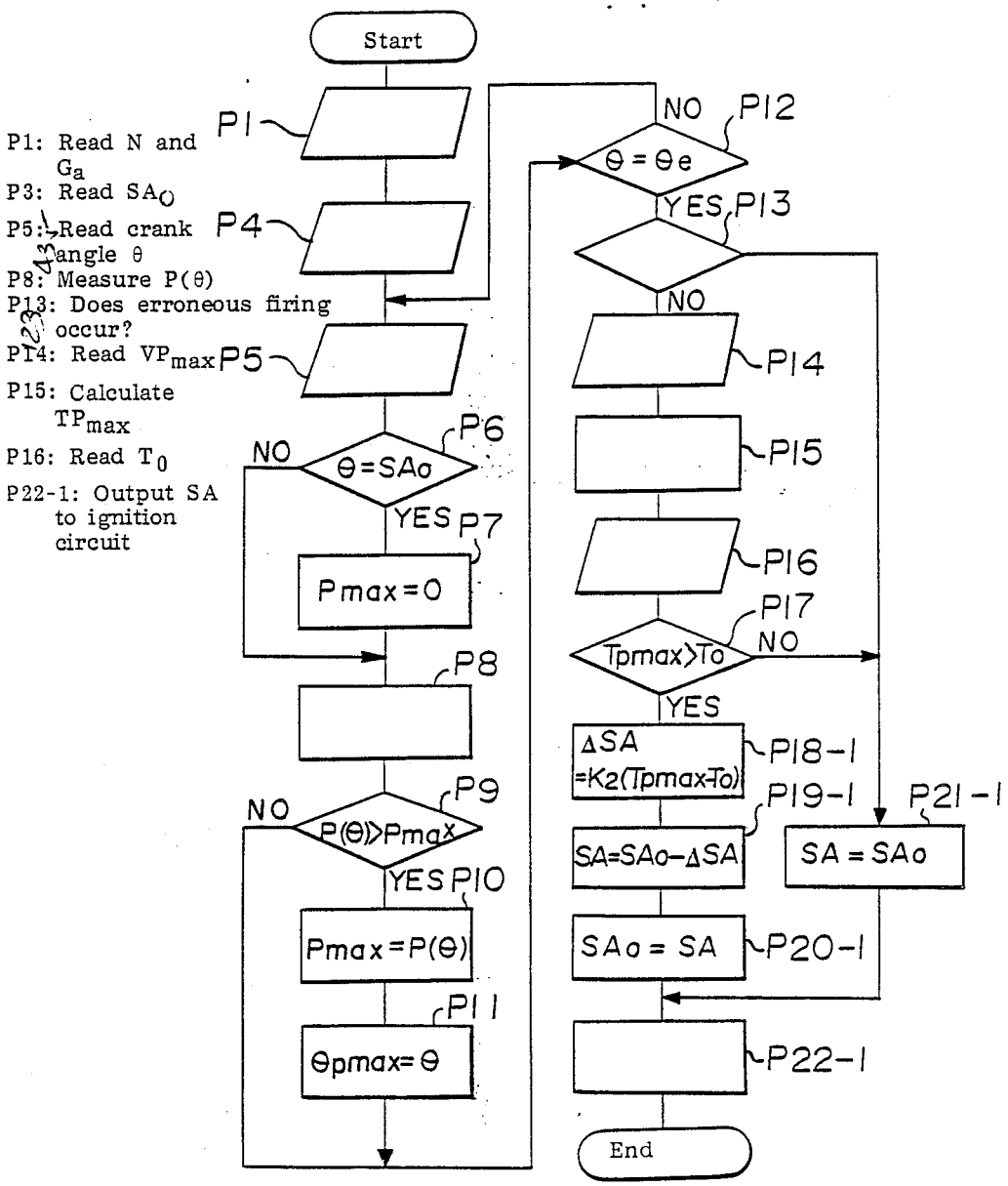
FIG. 9 is a flow chart showing a series of arithmetic processes of a third embodiment of the present invention.

FIG. 9 is a flow chart for controlling ignition timing which shows a flow of processes in a third embodiment according to the present invention. In FIG. 9, the processes of Step P1 and Step P4 through P17 are the same as those in FIG. 4.

At Step P17, determination is made as to whether or not the cylinder temperature $TP_{max}$ obtained at Step P15 is greater than the predetermined temperature $T_0$ read at Step P16.

When "YES", an ignition timing correction quantity SA is calculated by using the following equation (8) at Step P18-1:

$$\Delta SA = K_2 (TP_{max} - T_0) \quad (8)$$

where $K_2$ is a constant.

At Step P19-1, an ignition timing SA is calculated by using the following equation (9) in which the ignition timing $SA_0$ read at Step P4 and the ignition timing correction quantity $\Delta SA$ obtained at Step S18-1 are used:

$$SA = SA_0 - \Delta SA \quad (9)$$

Figure 10:
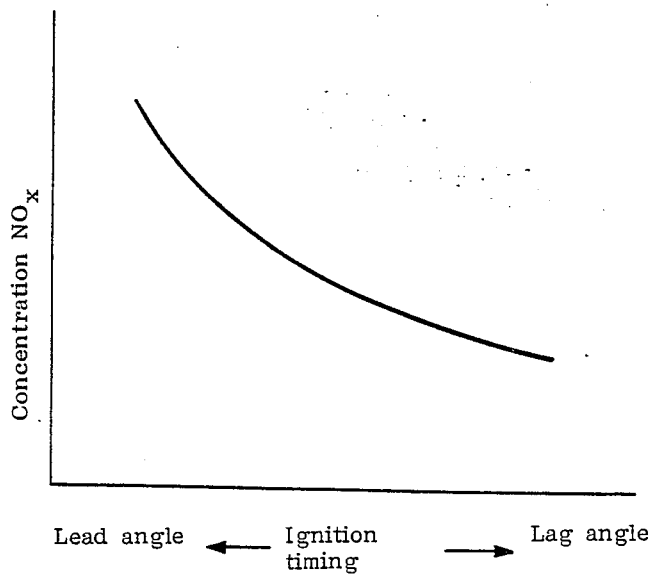
FIG. 10 is a characteristic diagram showing the relation of an ignition timing and the concentration of $NO_x$ to illustrate the third embodiment of the present invention.

The equation (9) is to move the ignition timing toward the lag angle side and the cylinder temperature is decreased as shown in FIG. 10.

At Step S20-1, the content of the data table concerning ignition timing is changed.

When "NO" at Step P17, the ignition timing SA is changed to the basic ignition timing $SA_0$ read at Step P4 (at Step P21-1). At Step P22-1, a signal of ignition timing SA is supplied to an ignition circuit.

By repeating the above-mentioned processes, the feed-back control of the ignition timing is effected so that the cylinder temperature $TP_{max}$ does not exceed the predetermined temperature $T_0$ to thereby control generation of $NO_x$.

In the embodiment shown in FIG. 1, only one cylinder 5 is shown. However, the present invention is applicable to a multi-cylinder engine. Namely, it is possible to correct an air-fuel ratio and an ignition timing for each of the cylinders in response to signals from a pressure sensor and an air flow sensor disposed in each of the cylinders.

In FIG. 1, the air flow sensor is used as means for detecting an intake air quantity. However, it is possible to calculate an intake air quantity by operating an engine revolution speed and a negative pressure in an intake air pipe.

In the above-mentioned embodiment, a pressure sensor is provided at each cylinder to detect an inner pressure of cylinder. However, correction of fuel injection for all cylinders is possible.

Further, correction for all cylinders is possible by using a single pressure sensor and a single air flow sensor for the cylinders.

Description has been made as to use of an air mixture adjusting device and a fuel injection valve. However, the same effect can be obtained by using a carburetor.

As described above, in accordance with the first embodiment of the present invention, a cylinder temperature is obtained by a pressure sensor at the time when an inner pressure of a cylinder assumes the maximum value, and a feed-back control is effected for at least one of an air-fuel ratio and an ignition timing so that the value of cylinder temperature is lower than a predetermined value. Accordingly, increase in an amount of $NO_x$ can be suppressed to thereby prevent the concentration of $NO_x$ in exhaust gas from abnormally increasing. Further, a cylinder temperature which directly affects generation of $NO_x$ can be lower than a predetermined value.

Figure 11:
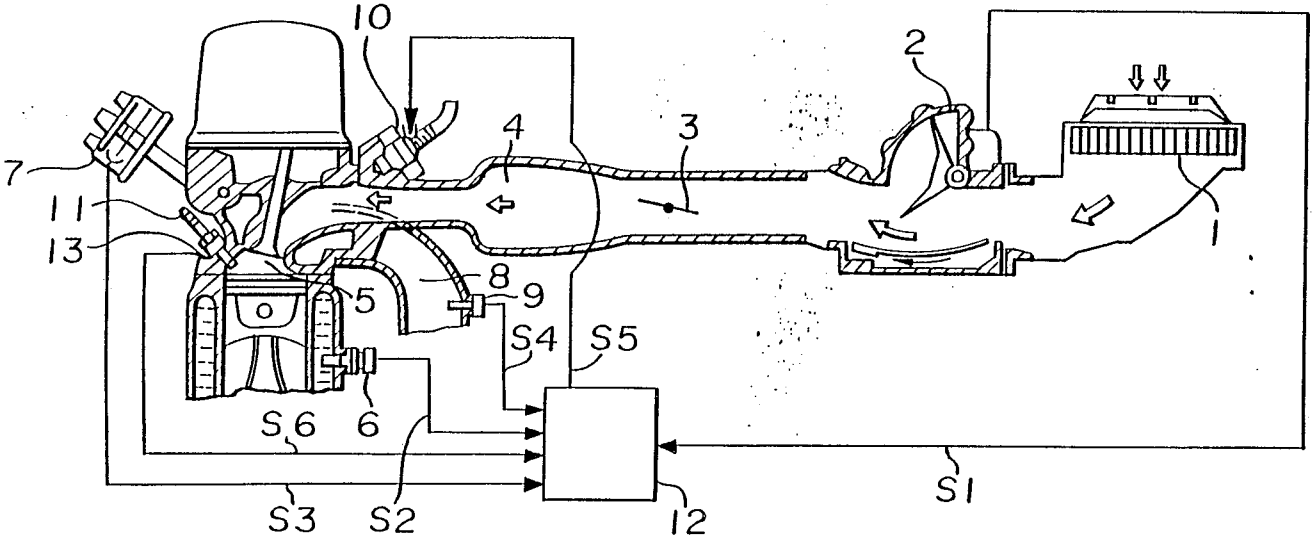
FIG. 11 is a diagram of an embodiment of the fuel injection timing control apparatus for an internal combustion engine according to the present invention.

A fourth embodiment of the control apparatus according to the present invention will be described with reference to FIG. 11, wherein the same reference numerals as in FIG. 1 designate the same or corresponding parts.

A crank angle sensor 7 produces a reference position pulse and a unit angle pulse, and an engine revolution number N can be obtained in the same manner as the first embodiment.

The crank angle sensor is disposed in a distributor.

A control apparatus 12 is constituted by a micro computer comprising, for instance, a CPU, an RAM, an ROM and an input interface. The control apparatus 12 receives an intake air quantity signal S1 from an air flow meter 2, a water temperature signal S2 from a water temperature sensor 6, a crank angle signal S3 from the above-mentioned crank angle sensor 7, an exhaust gas signal S4 from an exhaust gas sensor 9, a pressure signal S6 from a pressure sensor 13, a battery voltage signal and a throttle full-opening signal and so on, and operates the signals to thereby calculate a value of fuel injection quantity to be supplied to the engine, whereby a fuel injection signal S5 is outputted. A fuel injection valve 10 is actuated by the signal S5 to thereby supply a predetermined amount of fuel to the engine.

Calculation of a fuel injection quantity $T_i$ is conducted in the control apparatus 12 by using the following equation (10):

$$T_i = T_p \times (1 + F_t + KMR/100) \times \beta + T_s \quad (10)$$

where $T_p$ is a basic injection quantity which is obtained by a formula $T_p = K_0 \times G_a/N$ where $G_a$ is an intake air flow rate, N is an engine revolution number and $K_0$ is a constant, $F_t$ is a correction coefficient corresponding to a cooling water temperature for the engine which assumes a greater value as the water temperature decreases, and KMR is a correction coefficient for a heavy load (for instance, it is memorized in a data table as a value corresponding to both the basic injection quantity $T_p$ and the engine revolution number N, the coefficient being readable from the table, $T_s$ is a correction coefficient changing dependent on a battery voltage, which is to correct variation in voltage to actuate the fuel injection valve 10, and $\beta$ is a correction coefficient corresponding to the exhaust gas signal S4 from the exhaust air sensor 9, by which a feed-back control of the air-fuel ratio of a gas mixture can be effected so that the air-fuel ratio is maintained at a predetermined value, i.e. at or near a theoretical air-fuel ratio of 14.6.

Figures 12, 13:
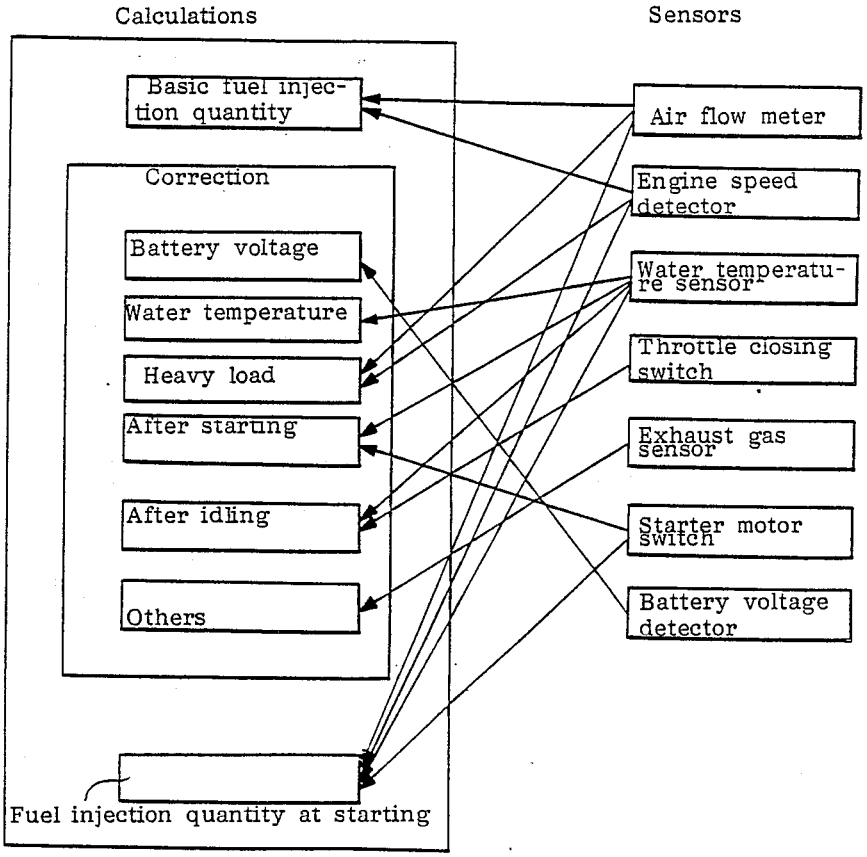
FIG. 12 is a data table of heavy load correction coefficients related to temperatures of cooling water for the engine.
FIG. 13 is a diagram showing the content of arithmetic operations and sensors related to the operations.

Since the air-fuel ratio of the gas mixture is controlled at a constant level by the feed-back control, correction by the cooling water temperature and correction by the heavy load become meaningless. Accordingly, the feed-back control by the exhaust gas signal S4 can only be conducted when the correction coefficient $F_t$ by the water temperature and the correction coefficient KMR by the heavy load are zero. FIG. 13 shows the relation between the items of correction and sensors.

A pressure sensor 13 of the same type as the first embodiment can be used.

Figure 14:
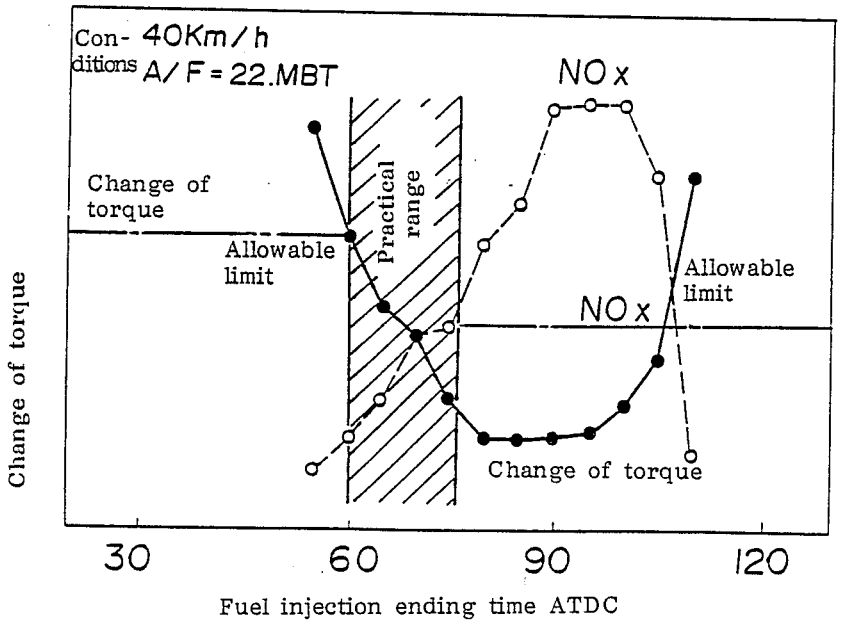
FIG. 14 is a characteristic diagram concerning the time of finishing fuel injection, a change of torque and the concentration of $NO_x$ obtained in the embodiment of the present invention.

FIG. 14 is a diagram showing an amount of $NO_x$ which is variable depending on a fuel injection time and variation of torque. When a fuel injection is so designed as to finish nearly 90° behind the upper dead point in a intake stroke, a flow of intake air produced by the movement of a piston effectively functions to form very fine particles of fuel, whereby efficiency of combustion is increased and a stable torque is obtainable. However, when a combustion temperature becomes high, there causes a rapid generation of $NO_x$ and it exceeds an allowable limit. On the other hand, the fuel injection is finished 60° behind the upper dead point in the intake stroke, an amount of $NO_x$ is small, however variations of torque exceed an allowable limit.

It is, therefore, necessary to select a hatched area which satisfies the allowable limit of both the torque variations and $NO_x$ quantity practically.

Figure 15:
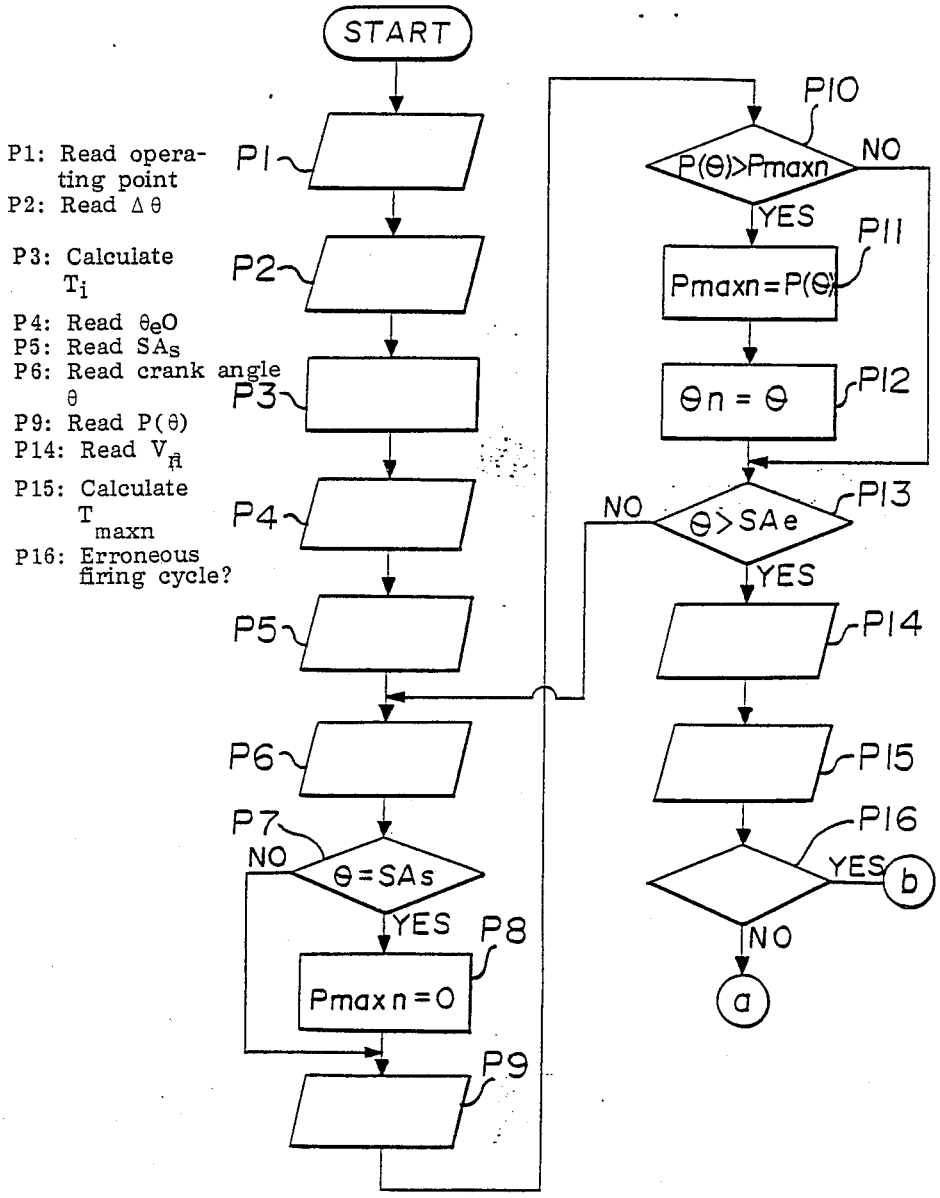
FIGS. 15A and 15B are respectively flow charts showing the operations of the control apparatus shown in FIG. 11.
Figure 15:
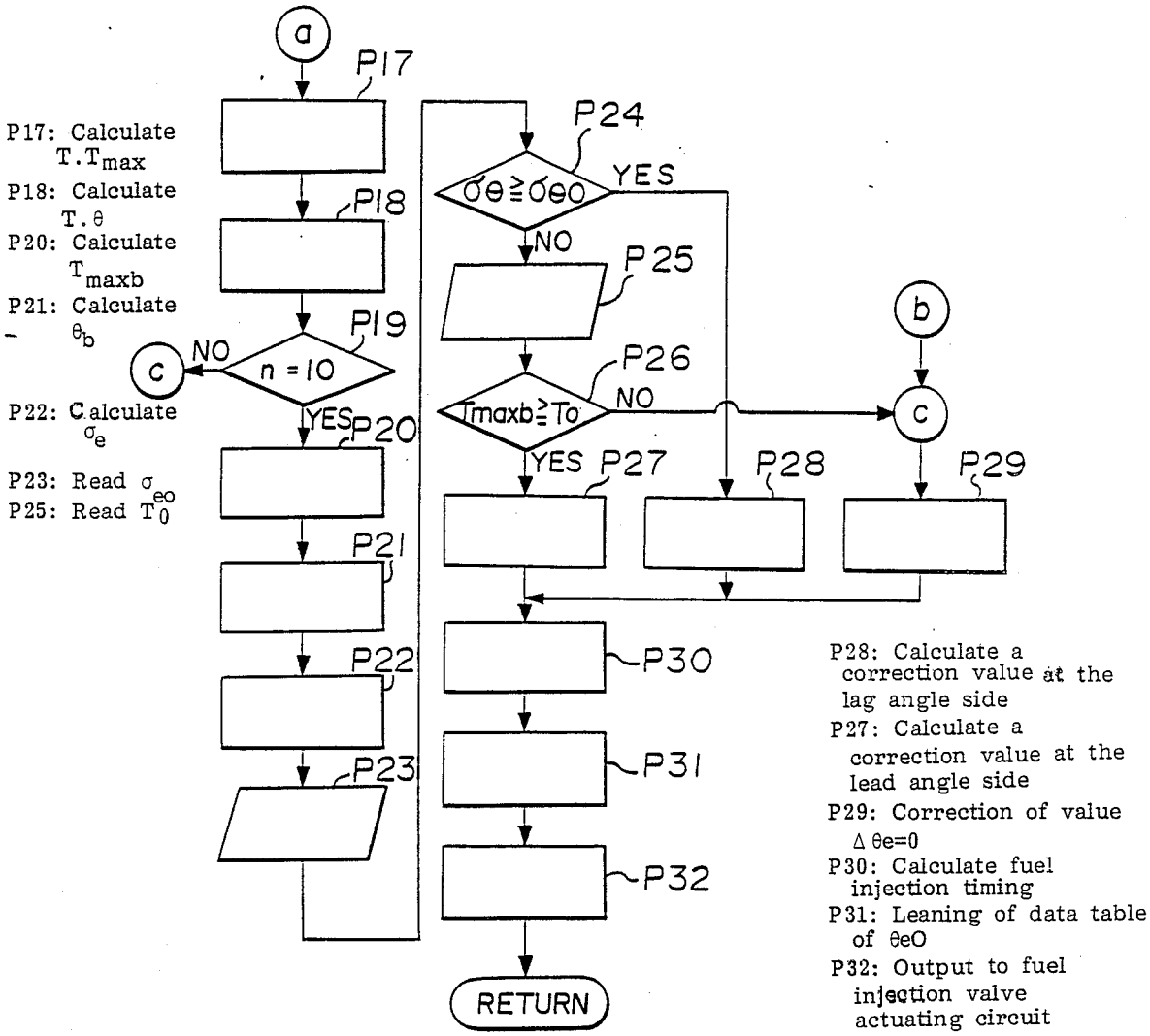

FIG. 15 is a flow chart showing an example of a program to effect an open/close control of the fuel injection valve 10 by the control apparatus 12. The program is interrupted at each time of the generation of the reference position (intake air TDC) signal from the crank angle sensor. The summary of processes shown in FIG. 15A will be described. In the flow chart of FIG. 15A, a fuel injection quantity is calculated based on an engine operating point; a basic fuel injection timing and an ignition timing previously preferred in a data table are read; the maximum inner pressure of cylinder $P_{maxn}$ produced at a predetermined crank angle period (from $SA_s$ to $SA_e$) as well as a crank angle $\theta_n$ at which the maximum inner pressure $P_{maxn}$ takes place is obtained, and then, the maximum temperature of gas in cylinder $T_{maxn}$ is calculated.

Now sequential Steps P1, P2, P3 . . . will be described in this order.

At Step P1, an engine operating point is obtained from an engine revolution number N and an intake air quantity $G_e$ or an inner pressure $P_b$ of intake air pipe.

At Step P2, a sampling crank angle $\Delta\theta$ at an inner pressure of cylinder which corresponds to the engine revolution number N is read from a data table. This value is to eliminate a disadvantage that calculation concerning a fuel injection timing (described below) within one ignition cycle during a high speed operation of the engine is not finished. The value $\Delta\theta$ changes at several stages depending on an engine revolution number N.

At Step P3, a fuel injection quantity $T_i$ corresponding to the engine operating point is calculated by using the above-mentioned equation (10). At Step P4, a basic fuel injection ending time $\theta_e O$ which is previously determined is read from a data table.

At Step P5, an ignition timing corresponding to the engine operating point is read from a data table and then, a crank angle $\theta$ is also read at Step P6.

At Step P7, determination is made as to whether or not the crank angle $\theta$ read at Step P6 is in agreement with the ignition timing $SA_s$ read at Step P5. When "NO" (negative), Step P9 is taken. When "YES" (affirmative) at Step P7, the maximum inner pressure of cylinder $P_{maxn}$ at the previous time is changed to zero, and an inner pressure of cylinder $P(\theta)$ at the present time is read at Steps P8, P9.

At Step P10, determination is made as to whether or not the inner pressure of cylinder $P(\theta)$ read at Step P9 is greater than the maximum inner pressure of cylinder $P_{maxn}$ up to the previous time (n means the n th ignition cycle).

When "NO" at Step P10, Step P13 is immediately taken. When "YES", the inner pressure of cylinder $P(\theta)$ at the present time is memorized as the maximum inner pressure of cylinder $P_{maxn}$. Then, the crank angle $\theta$ at the maximum inner pressure $P_{maxn}$ is changed to $\theta_n$ and is stored at Step P12.

Figure 16:
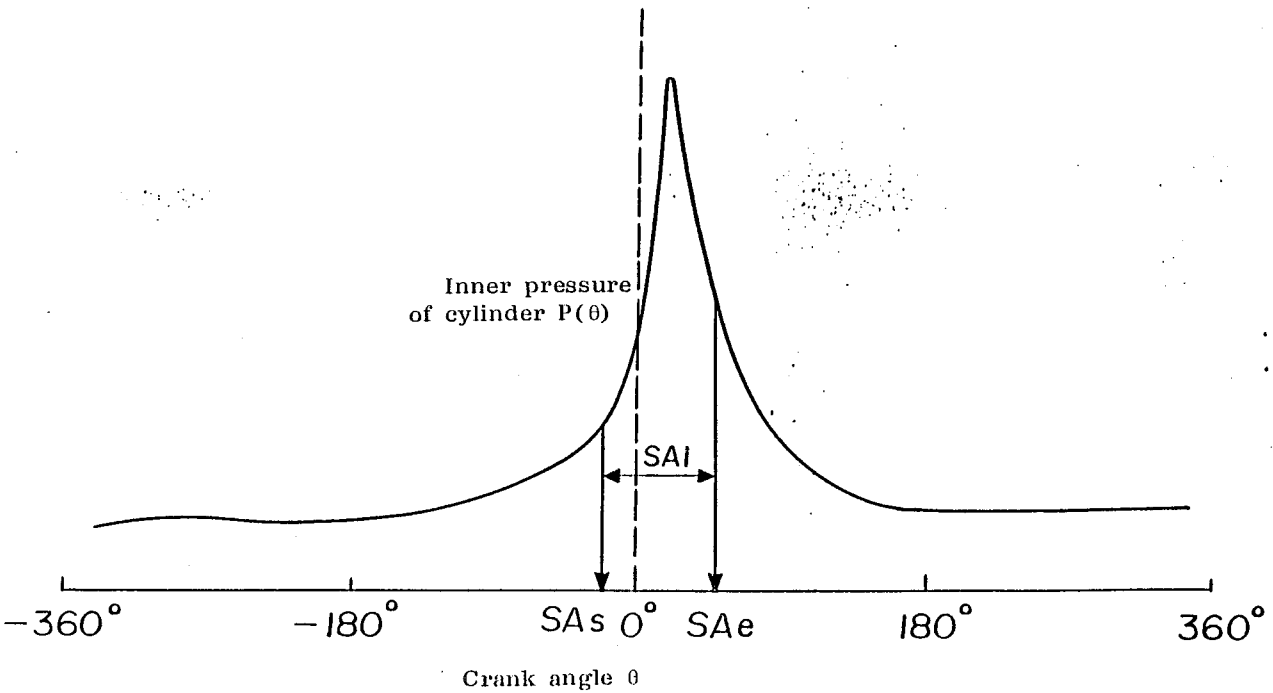
FIG. 16 is a characteristic diagram showing the relation between an inner pressure of cylinder and a crank angle.

At Step P13, determination is made as to whether for not the crank angle $\theta$ read at Step P6 is greater than the crank angle $SA_e$ obtained by the equation (11). In this case, $SA_s$ is an ignition timing read at P5 and $SA_i$ is a range in which the maximum inner pressure of cylinder is produced. It is necessary to obtain the value $SA_i$ previously from experiments so that the maximum inner pressure $P_{maxn}$ is produced between $SA_s$ and $SA_e$ as shown in FIG. 16.

$$SA_e = SA_s + SA_i \quad (11)$$

When "YES" at Step P13, it is out of the range, and Step P14 is taken. When "NO", the sequential operation is returned to Step P6 to repeat the above-mentioned processes.

At Step P14, the cylinder capacity $V_n$ is read from a data table by using the crank angle $\theta_n$ obtained at Step P12.

At Step P15, the maximum temperature of gas in cylinder $T_{maxn}$ is calculated by using the following equation (12):

$$T_{maxn} = (P_{maxn} \times V_n)/(R \times G_a/N \quad (12)$$

where $P_{maxn}$ is the maximum inner pressure of cylinder, $V_n$ is a cylinder capacity at the time of obtaining the maximum inner pressure, $G_a$ is a flow rate of intake air, R is a constant of gas and N is an engine revolution number.

At Step P16, determination is made as to whether or not the present cycle is an erroneous firing cycle. When a value of the crank angle $\theta_n$ memorized at Step P12 is near the upper dead point in a compression stroke and the maximum temperature of gas in cylinder $T_{maxn}$ is lower than a predetermined value (i.e. "YES"), the determination of erroneous firing is made an Step P29 in FIG. 15B is taken.

When "NO" at Step P16, the contrary determination is made and Step P17 in FIG. 15B is taken.

In the above-mentioned fourth embodiment, the maximum temperature of gas in cylinder $T_{maxn}$ is used to detect the erroneous firing. However, it is possible to use a rate of increase of the inner pressure of cylinder $dP/d\theta$ or an amount of heat Q.

In the processes from Step P17 to Step P21 in FIG. 15B, the mean value of the crank angle position $\theta_n$ at which the maximum pressure is produced in certain cycles and the mean value of the maximum temperature of gas in cylinder $T_{maxn}$ in certain cycles are respectively obtained. The total value $T.\theta$ of $\theta_n$ is calculated at Step P17 and the total value $T.T_{maxn}$ of $T_{maxn}$ is calculated at Step P18.

At Step P19, determination is made as to whether or not the number of sampled cycles n becomes a predetermined value. In this embodiment, a case of n=10 is used, however, another numeral may be used depending on an engine revolution number and a load.

When "NO" at Step P19, Step P29 is taken.

When "YES" at Step P19, the mean value $\theta_b$ of the crank angle position at which the maximum inner pressure of the cylinder is produced is calculated, and the mean value $T_{maxb}$ of the maximum temperature of gas in the cylinder is calculated at Step P20.

At Step P21, a rate of change $\sigma\theta$ with respect to an n number of $\theta_n$ memorized at Step P12 is calculated. In this embodiment, the standard deviation of the crank angle $\theta_n$ at which the maximum inner pressure of the cylinder is produced is calculated by an equation (13) by which the rate of change $\sigma\theta$ is obtained. However, the unbiased variance $\sigma\theta$ of the crank angle $\theta_n$ may be used. Further, the standard deviation $\sigma P_{max}$ of the maximum inner pressure of cylinder $P_{maxn}$ or the unbiased variance $\sigma P_{max}$ of $P_{maxn}$ may be used.

$$\sigma\theta = \sqrt{1/n\Sigma(\theta_n - \theta_b)^2} \quad (13)$$

Figure 17:
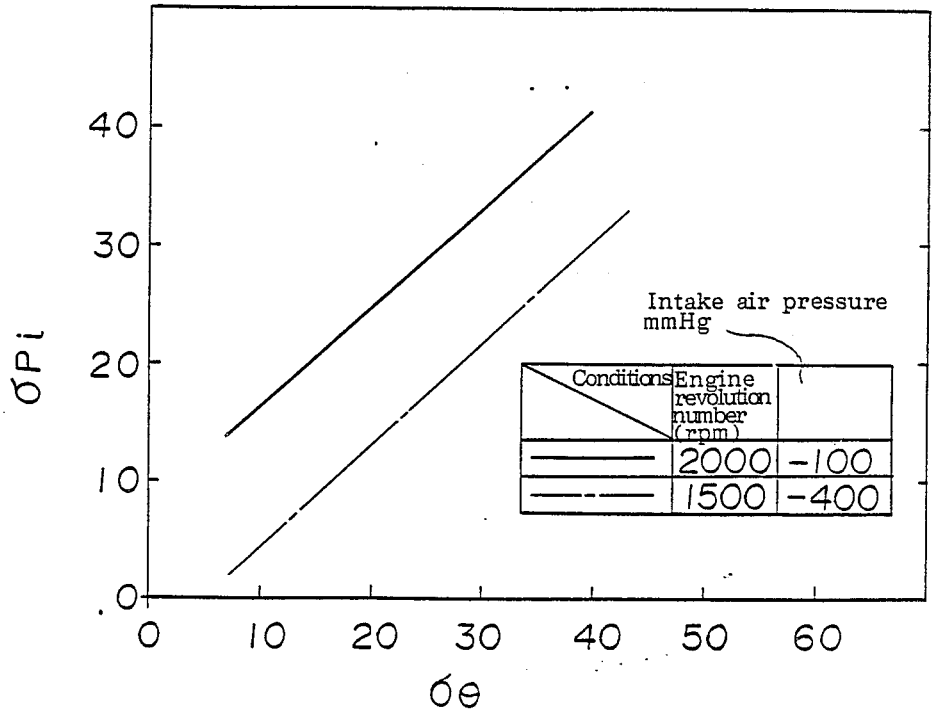
FIG. 17 is a characteristic diagram showing the relation between the standard deviation $\sigma\theta$ of crank angles at which the maximum pressure of cylinder are produced and the standard deviation $\sigma$Pi of the effective pressure by graphically representation.
Figure 18:
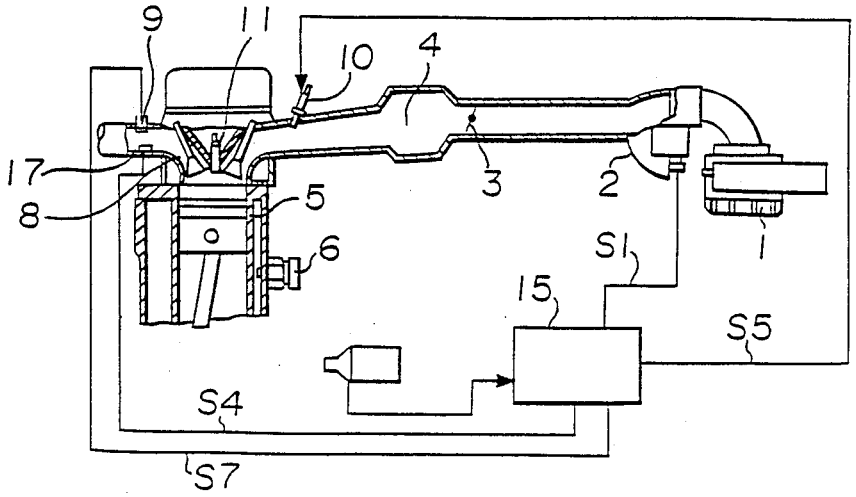
FIG. 18 is a diagram showing a conventional air-fuel ratio control apparatus.

FIG. 17 is a diagram showing the relation between the rate of change $\sigma\theta$ and a rate of change $\sigma P_i$ of graphically represented average effective pressure corresponding to a rate of change of torque. It is understood that there is a linear relation between both values, and it is understood that a change of torque can be replaced by $\sigma\theta$.

At Step P23, the allowable limit $\sigma$ of the rate of change which is determined depending on operational conditions of the engine is read from a date table. At Step P24, determination is made as to whether or not the rate of change $\sigma\theta$ obtained at Step P22 is greater than the allowable limit $\sigma$ of the rate of change read at Step P23.

When "YES" at Step P23, it means that a change of torque exceeds the allowable limit. Accordingly, it is necessary to control the change of torque to be reduced, i.e. a fuel injection ending time is deflected toward the lag angle side. To control the lag angle, a lag angle correction quantity is calculated by using the following equation (14) at Step P28 and then, Step P30 is taken.

$$\Delta\theta_e = K1 \times (\sigma\theta - \sigma O) \quad (14)$$

where K1 is a constant.

When "NO" at Step P24, there is possibility that an amount of $NO_x$ in exhaust gas is beyond the allowable range even though the change of torque is within the allowable range. Accordingly, at Step P25, the limit value $T_0$ of the maximum temperature of cylinder corresponding to the limit value in amount of $NO_x$ is read from a data table.

At Step P26, determination is made as to whether or not the mean value $T_{maxb}$ of the maximum temperature of cylinder obtained at Step P20 is greater than the value $T_0$ read at Step P25. When "YES", then, Step P27 is taken to advance the fuel injection ending time.

At Step P27, a lead angle correction value is calculated by using the following equation (15):

$$\Delta\theta_e = K2 \times (T_0 - T_{maxb}) \quad (15)$$

where K2 is a constant.

When "NO" at Step P26, determination is made such that both the change of torque and an amount of $NO_x$ are in allowable ranges, and the correction value $\Delta\sigma_e$ is rendered to be zero. The correction value $\theta_e$ is also rendered to be zero without effecting correction concerning the fuel injection timing when the determination of erroneous firing is given at Step P14 and a sampling operation of a predetermined cycle is not finished at Step P19.

A fuel injection starting time $\theta_{st}$ is calculated at Step P30 by using the following equation (16):

$$\theta_{st} = \theta_e O + \Delta\theta_e - (T_i \times K3/N) - \tau \quad (16)$$

where $\theta_e O$ is the above-mentioned basic fuel injection ending time read at Step P4, $\Delta\theta_e$ is the correction value obtained at Steps P27–P29, $T_i$ is the fuel injection quantity obtained at Step P3, K3 is a constant, N is an engine revolution number and $\tau$ is a waste time related to transportation of fuel which is obtained from the following equation:

$$\tau = K4 \times (V_f \times L) \quad (17)$$

where K4 is a constant, $V_f$ is a fuel injection velocity and L is a distance from the fuel injection valve to an intake valve.

At Step P31, the data table of the basic fuel injection ending time $\theta_e O$ is changed in accordance with the following equation (18):

$$\theta_e O \text{ (present time)} = \theta_e O \text{ (previous time)} + \Delta\theta_e \quad (18)$$

Thus, the value $\theta_e O$ containing the correction value obtained up to the previous time is read when the engine is operated with the same operating point. Accordingly, good response and accuracy in the fuel injection timing control are improved.

At Step P32, the fuel injection starting time $\theta_{st}$ obtained at Step P30 is supplied to the fuel injection valve actuating circuit. Thus, by repeating the above-mentioned operations, it is possible to control a fuel injection timing so as to maintain the optimum relation between the change of torque and an amount of $NO_x$.

The same kind of processors as described in the first embodiment may be used for the fourth embodiment to carry out operations and calculations in accordance with the flow chart in FIG. 15 to thereby obtainable the same effect as in the first embodiment.

In accordance with the fourth embodiment, by obtaining a parameter indicating the situations of the maximum temperature of gas in the cylinder and an output of engine by detecting an inner pressure of cylinder, a fuel injection timing is controlled at the lead angle side or the lag angle side. Accordingly, the concentration of $NO_x$ in exhaust gas can be controlled at a level lower than a predetermined value, and at the same time, an output torque from the engine can be stabilized.

Obviously, numerous modifications and variations of the present invention are possible in light of the above teachings. It is therefore to be understood that within the scope of the appended claims, the invention may be practiced otherwise than as specifically described herein.

What is claimed is:

1. A control apparatus for a spark ignition type integral combustion engine adapted to measure an intake air quantity and an engine revolution number, to calculate a basic fuel injection quantity by taking account of the intake air quantity and the engine revolution number and to inject fuel on the basis of a signal of the basic fuel injection quantity, which comprises:

a pressure detecting means to detect an inner pressure of at least one cylinder P, a crank angle detecting means to detect a crank angle $\theta$ of the engine, and a control device having means for receiving the output signals of said pressure detecting means and said crank angle detecting means for determining the maximum inner pressure of said cylinder $P_{max}$ in a single ignition cycle and the crank angle at the time of the maximum inner pressure $\theta P_{max}$ taking place, means for calculating a temperature of a cylinder T as a function of the maximum inner pressure $P_{max}$ and the crank angle $\theta P_{max}$ at said pressure $P_{max}$, means for outputting a control signal for controlling fuel on the basis of the calculated temperature T at the pressure $P_{max}$, and means for operating an engine control variable depending on said control signal.

2. The control apparatus according to claim 1, wherein said engine control variable is at least one of an air-fuel ratio and an ignition timing.

3. The control apparatus to claim 1, wherein a range of said crank angle for detecting the inner pressure of cylinder P is from an ignition timing $\theta_{SA}$ to a predetermined crank angle $\theta_e$.

4. The control apparatus according to claim 1, wherein said control device includes means for controlling said internal combustion engine without using said engine control variable when said crank angle at the time of maximum inner pressure is at or near the upper dead point of a compression stroke and a rate of change $dP/d\theta$ of the inner pressure of a cylinder is less than a predetermined value.

5. The control apparatus according to claim 1, including means for obtaining said temperature T of a cylinder at the pressure $P_{max}$ by using an equation of:

$$T = (P_{max} \cdot VP_{max})/(G_a/N.R)$$

where $G_a$ is an air flow rate of intake air, $P_{max}$ is the maximum inner pressure of cylinder, R is a constant of gas, N is an engine revolution number and $VP_{max}$ is a cylinder capacity which is read from a data table at the crank angle at the time of maximum inner pressure and maximum inner pressure $P_{max}$.

6. The control apparatus according to claim 1, wherein the content of a data table which determines said manipulated variable by using said temperature of cylinder T is obtained by learning.

7. The control apparatus according to claim 1, wherein said manipulated variable is determined by using a mean value $TP_{maxb}$ which is obtained by calculating the average value of the temperature values T in predetermined cycles.

8. A control apparatus for a spark ignition type internal combustion engine adapted to measure an intake air quantity and an engine revolution number, to calculated a basic fuel injection quantity by taking account of the intake air quantity and the engine revolution number, and to inject fuel on the basis of a signal of the basic fuel injection quantity, which comprises:

a pressure detecting means to detect an inner pressure of cylinder P, a crank angle detecting means to detect a crank angle $\theta$ of the engine, and a control device comprising means for receiving the outputs of detection signals of said both detecting means to calculate a parameter showing a change of power in a single ignition cycle, means for calculating the mean value $T_{maxb}$ of maximum temperature values $T_{maxn}$ of gas in a cylinder in predetermined ignition cycles on the assumption that the temperature of gas in the cylinder produced at the maximum inner pressure of cylinder $P_{maxn}$ is the maximum temperature $T_{maxn}$, and means for controlling a fuel injection timing by using said parameter and said mean value $T_{maxb}$.

9. The control apparatus according to claim 1, wherein said parameter is at least one selected from the group consisting of the standard deviation $\sigma\theta$ of the crank angle $\theta_n$ at which the maximum inner pressure of a cylinder is produced, the unbiased variance $\sigma^2\theta$ of the crank angle $\theta_n$ at which the maximum inner pressure of the cylinder is produced, the standard deviation $\sigma P_{max}$ of the maximum inner pressure of cylinder $P_{max}$, and the unbiased variance of the maximum pressure of cylinder $\sigma^2 P_{max}$.

10. The control apparatus according to claim 8, wherein a range of said crank angle for detecting the inner pressure of cylinder P is from a ignition timing $SA_s$ to a predetermined crank angle $SA_e$ behind the upper dead point of a compression stroke.

11. The control apparatus according to claim 8, wherein said fuel injection timing is controlled without using said maximum temperature of cylinder $T_{maxn}$ when the crank angle $\theta_n$ at which the maximum pressure of a cylinder is produced is at or near the upper dead point of a compression stroke and the maximum temperature $T_{maxn}$ is less than a predetermined value.

12. The control apparatus according to claim 8, wherein said maximum temperature of cylinder $T_{maxn}$ is obtained by using an equation:

$$T_{maxn}=(P_{maxn}\times V_n)/(R\times G_a/N)$$

where $G_a$ is an air flow rate of intake air, $P_{maxn}$ is the maximum inner pressure of a cylinder, R is a constant of gas, N is an engine revolution number, $V_n$ is a cylinder capacity which is read from a data table corresponding to the crank angle $\theta_n$.

13. The control apparatus according to claim 12, wherein the content of said data table concerning the fuel injection timing is obtained by learning by using the parameter and the mean value $T_{maxb}$.

* * * * *